US005322074A

United States Patent [19]

Cross, Jr.

[11] Patent Number: 5,322,074

[45] Date of Patent: Jun. 21, 1994

[54] TOBACCO DELIVERY SYSTEM

[75] Inventor: Wiley E. Cross, Jr., Ordinary, Va.

[73] Assignee: The Cardwell Machine Company, Richmond, Va.

[21] Appl. No.: 907,482

[22] Filed: Jul. 1, 1992

[51] Int. Cl.[5] ..... A24C 5/39

[52] U.S. Cl. ..... 131/110; 131/108; 406/19; 406/168; 406/183

[58] Field of Search ..... 131/108, 109.2, 110, 131/84.1, 84.3; 209/906; 406/19, 168, 181-183

[56] References Cited

U.S. PATENT DOCUMENTS 3,386,773 6/1968 Ballard ..... 131/110 X
3,535,629 10/1970 Gibson et al. .
3,860,031 1/1975 Grilli ..... 131/110 X
3,989,309 11/1976 Preston .
4,516,888 5/1985 Kardinal ..... 406/182
4,557,278 12/1985 Brackmann et al. .
4,802,497 2/1989 Hrboticky .
4,832,058 5/1989 Lubbe .
4,867,180 9/1989 Brackmann et al. .
5,000,197 3/1991 Tallier et al. .

*Primary Examiner*—Jennifer Doyle
*Attorney, Agent, or Firm*—John F. C. Glenn

[57] ABSTRACT

An exhaust fan draws air and entrained tobacco through delivery pipes from a tobacco feeder to the respective dischargers of a group of cigarette making machines, where the tobacco is screened out and the air passes on through exhaust pipes. When a discharger is to release tobacco to its making machine the feeder stops delivery of tobacco to that discharger and, after a delay to clear the delivery pipe, a valve bypasses the air around the discharger so that a constant air flow is maintained. The feeder supplies tobacco in a separate and independently controlled stream to each discharger, and has oscillating vanes to separate and keep the tobacco moving.

7 Claims, 11 Drawing Sheets

TOBACCO DELIVERY SYSTEM

FIELD OF THE INVENTION

The field of the invention is delivery of tobacco or other loose fibrous material from a single feeder to several machines using it, such as cigarette making machines.

BACKGROUND OF THE INVENTION

Tobacco filler is conventionally supplied to a group of cigarette making machines from a single feeder unit. The feeder separates the tobacco for the respective machines and a centrifugal exhaust fan draws the separated tobacco in separate air streams from the feeder to the machines. A tobacco discharger on each machine receives the incoming air stream and entrained tobacco for the machine, screens out and retains the tobacco, and permits the screened air to continue on to the exhaust fan. The discharger cannot release the retained tobacco for use by its machine, as required at fairly frequent intervals, without stopping the flow of air through the discharger while each release is completed. This is done by closing a valve on the air outlet from the discharger, thus isolating the discharger from the fan suction which would otherwise close an outlet door from the discharger to its machine. The result is to stop all air flow from the feeder to that discharger. If that happens in the case of more than one discharger at the same time, as occasionally occurs, the velocity and quantity of air drawn through the other dischargers increases, which tends to break the tobacco being drawn to the other dischargers. If all of the air outlet valves in the group happen to be closed simultaneously, for a prolonged period, such as lunchtime, the resultant loss in air flow may cause the fan to overheat.

When air to a discharger stops flowing the tobacco in that air comes to rest where it is along the line. This results in segregation by particle size and concentration of small pieces at one end or side of the discharger when air flow to the discharger resumes and carries the tobacco which had been at rest in the line into the discharger. Another problem is that the tobacco in conventional feeders may bridge and clump in the feeder if it continues to supply tobacco to less than all the outlets it is designed to feed. Segregation of the various sized particles may also occur.

SUMMARY OF THE INVENTION

The present invention provides a constant airflow system from a single tobacco feeder to all the tobacco dischargers of the cigarette making machines in the group it supplies, in spite of interruptions of flow of air through any of the dischargers of the machines during operation of the group as a whole. When a discharger in the group is discharging tobacco to its machine, the air to that discharger continues to flow but is bypassed around the discharger itself by a special valve across oppositely moving side by side portions of the airstream entering and leaving the discharger.

The feeder of the invention has means to separate the tobacco and deliver the separated portions as needed to the respective air streams leading to the dischargers of a group of cigarette machines, regardless of variations in the number of dischargers in the group which are simultaneously receiving tobacco. When one of the dischargers signals that it is full of tobacco, the feeder stops its delivery of tobacco to the airstream leading to that discharger, but that airstream is not bypassed around the discharger until all tobacco in the line has been drawn into and retained in the discharger. Movable vanes in the feeder unit divide the tobacco and keep it flowing under all feeding conditions, and independently operable sets of pin rolls beneath the vanes control movement of the separated portions of tobacco to the air streams leading to the respective dischargers.

Other advantages, objects and details of the invention will become apparent as the following disclosure proceeds.

DRAWINGS ILLUSTRATING THE INVENTION

The present preferred embodiment of the invention is shown in the following drawings in which.

Figure 2:
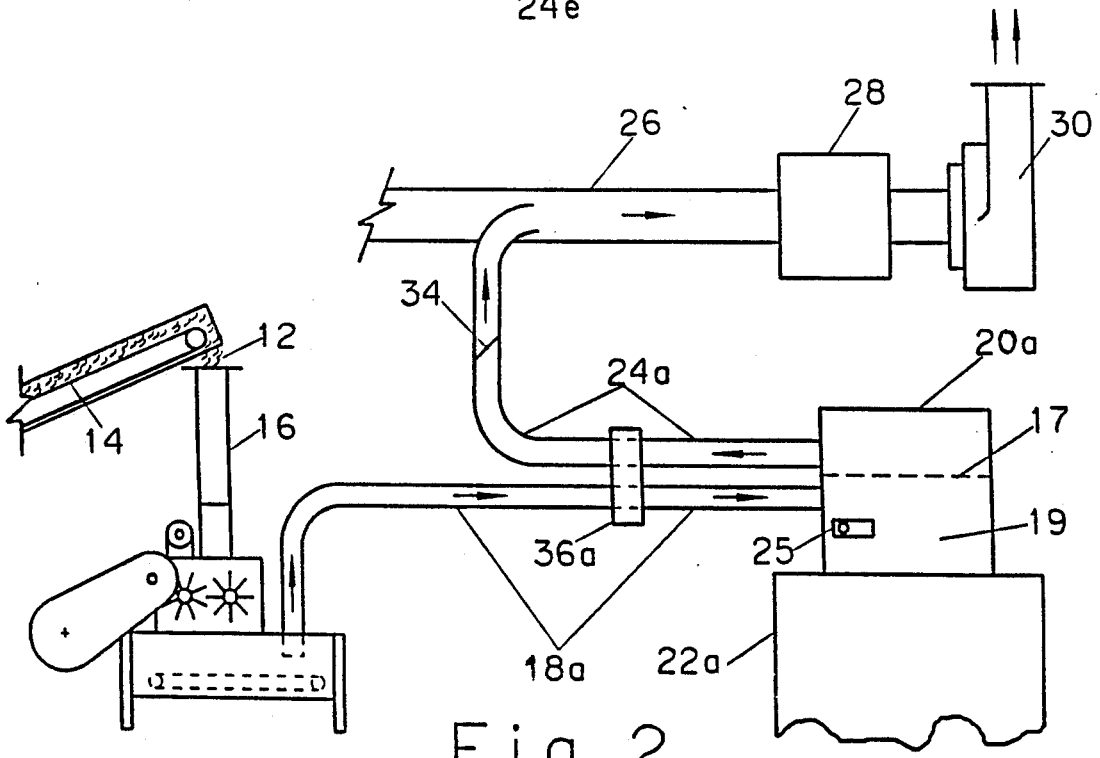
FIG. 2 shows a partially broken away semi-diagrammatic side view of the bulk supply unit, feeder and exhaust fan of FIG. 1, and one of the sets of making machines, dischargers and valves of FIG. 1, with the valve set for air flow through the discharger.
Figure 3:
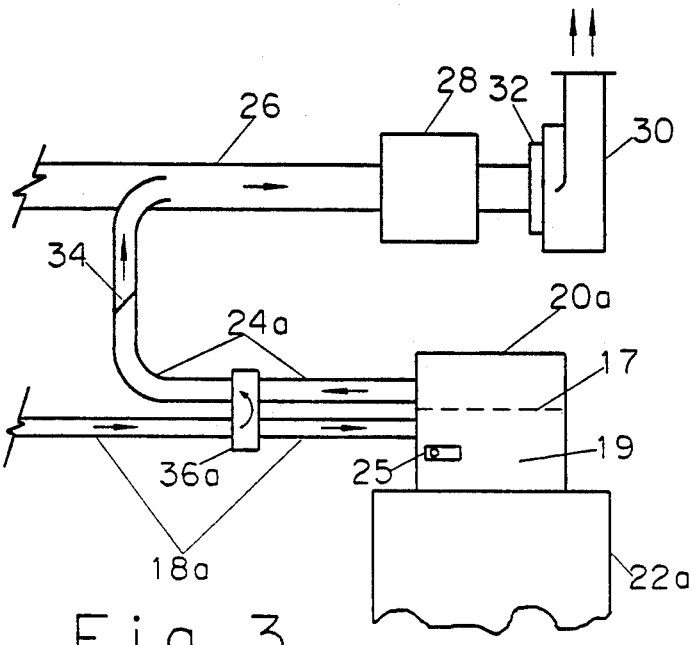
FIG. 3 shows a view corresponding to FIG. 2, but further broken away and showing the valve set to bypass air flow around the discharger.
Figure 4:
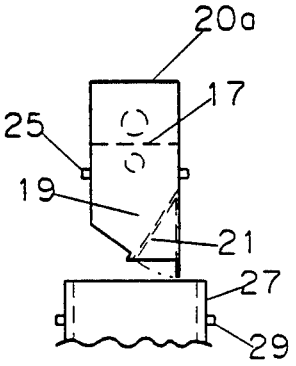
FIG. 4 shows an end view from the right of the discharger shown in FIG. 4, but omitting all of the making machine except its hopper for receiving tobacco from the discharger.
Figure 7:
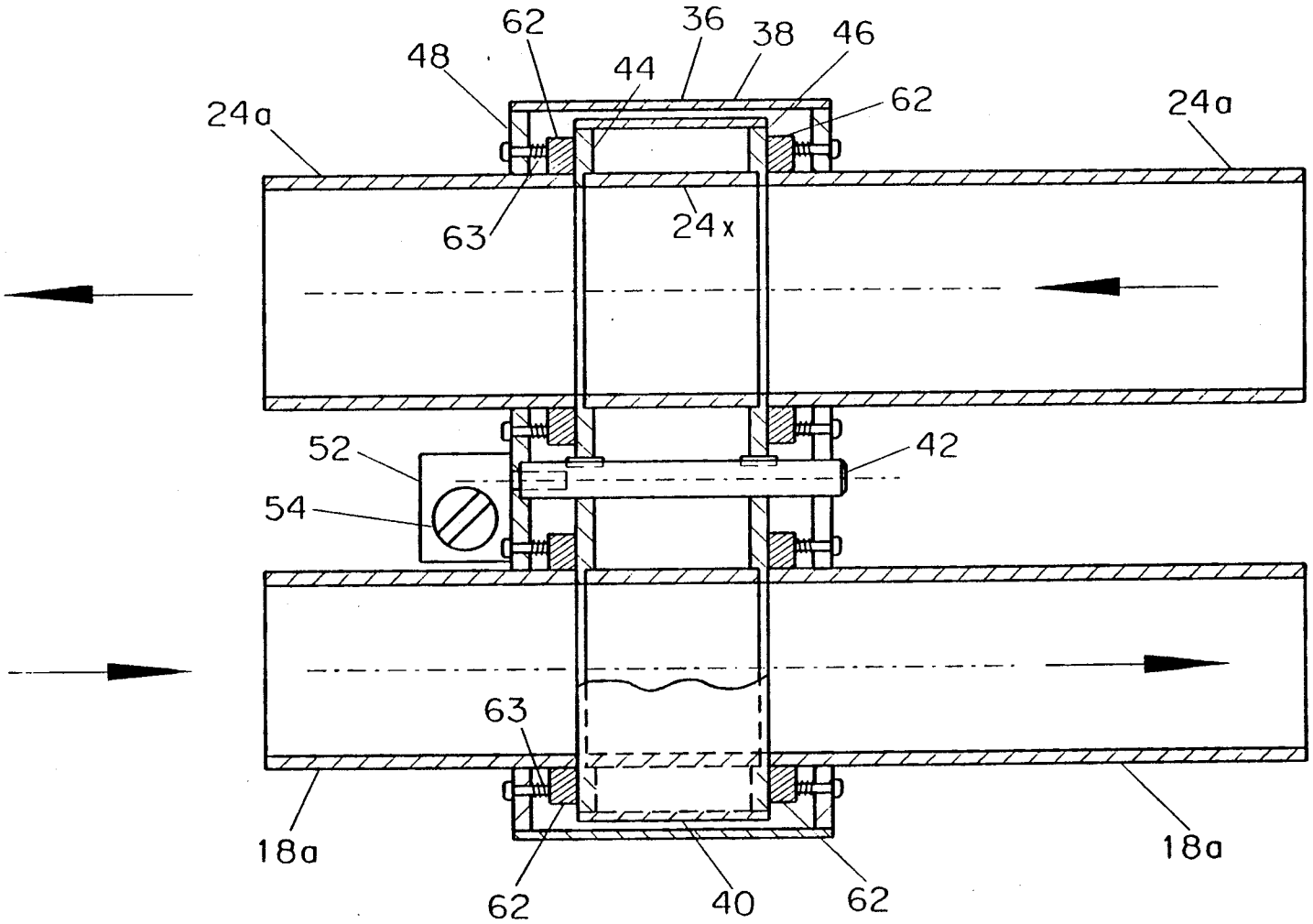
Figures 8, 9:
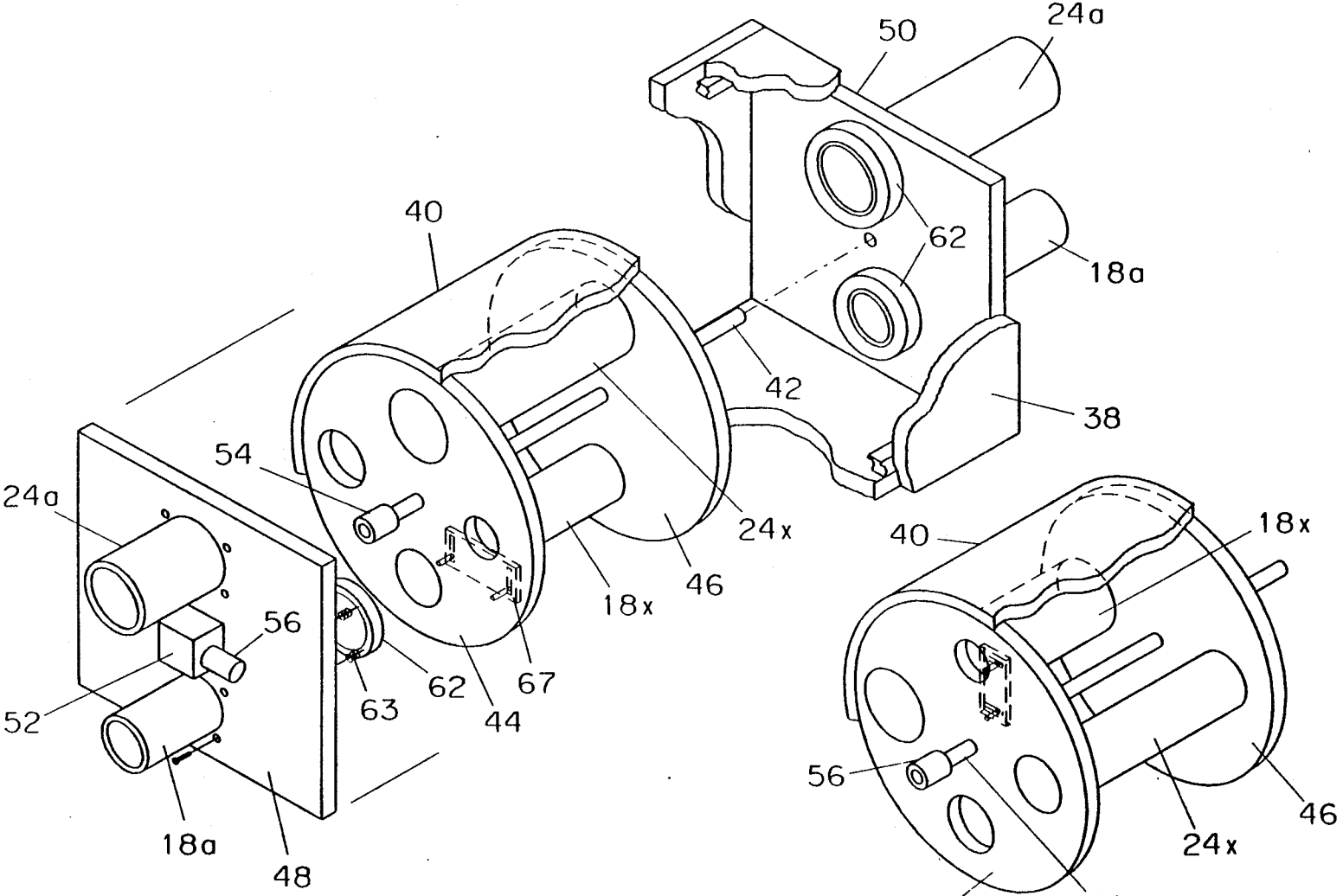
Figure 10:
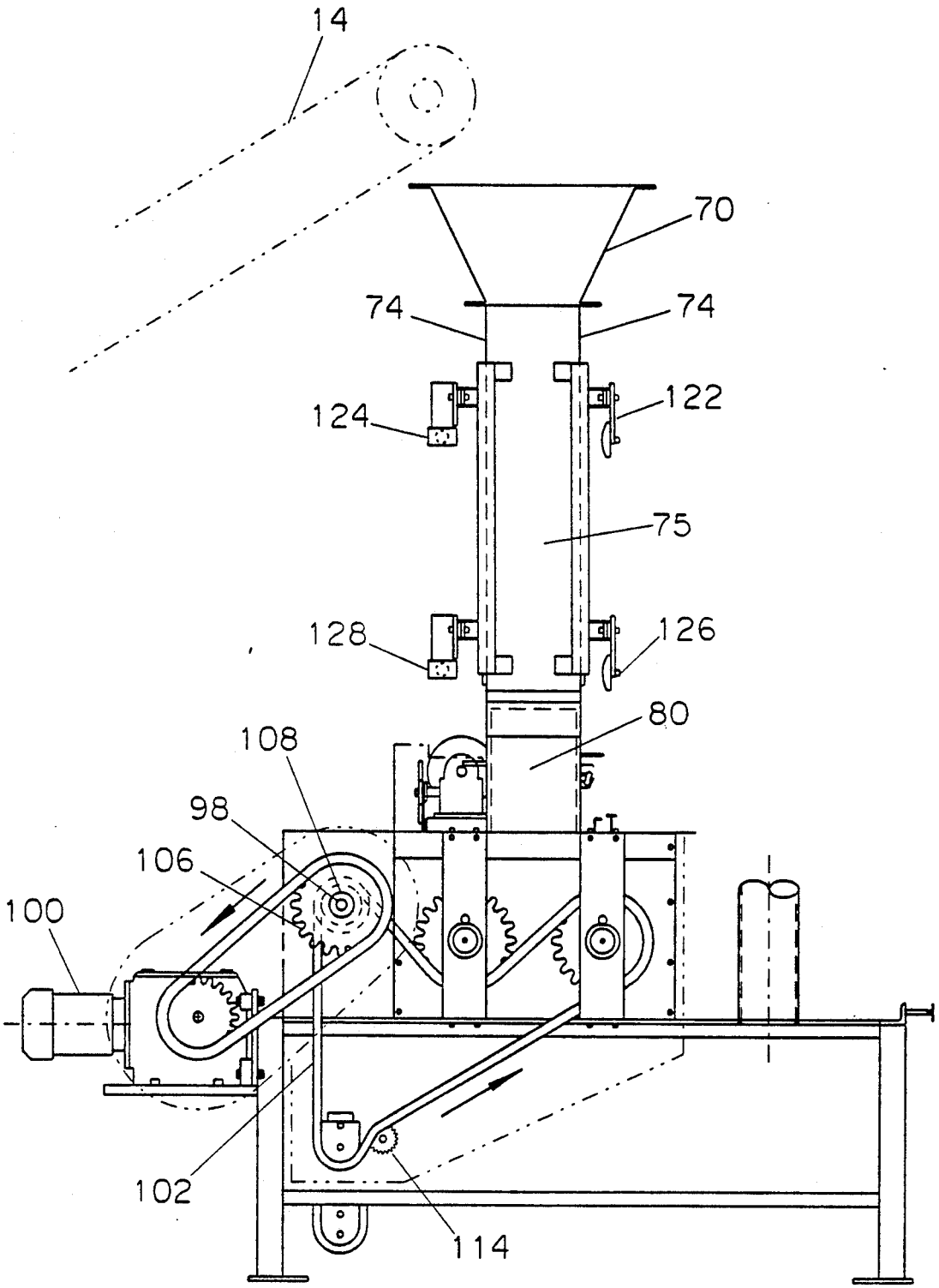
Figure 11:
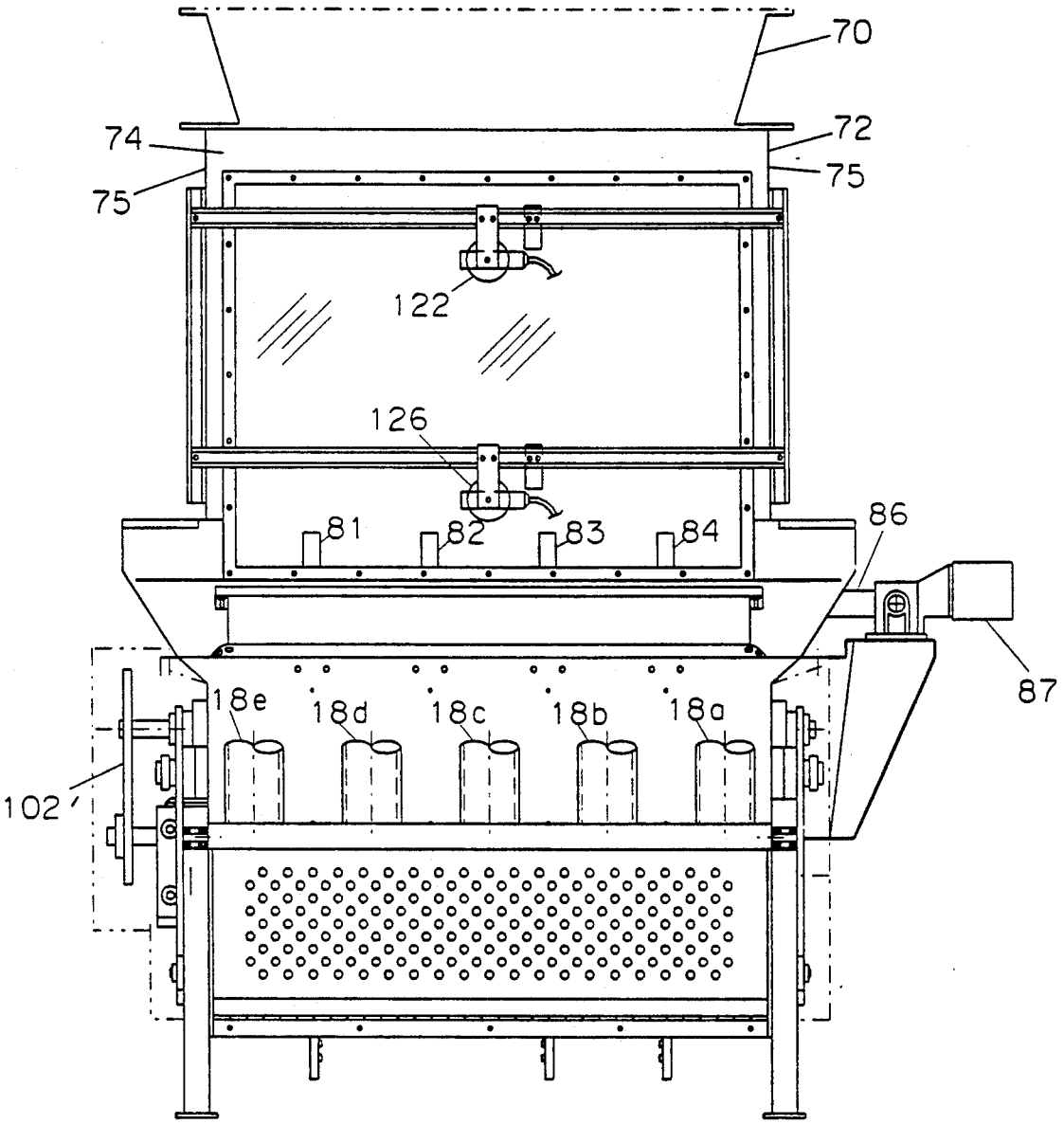
Figure 12:
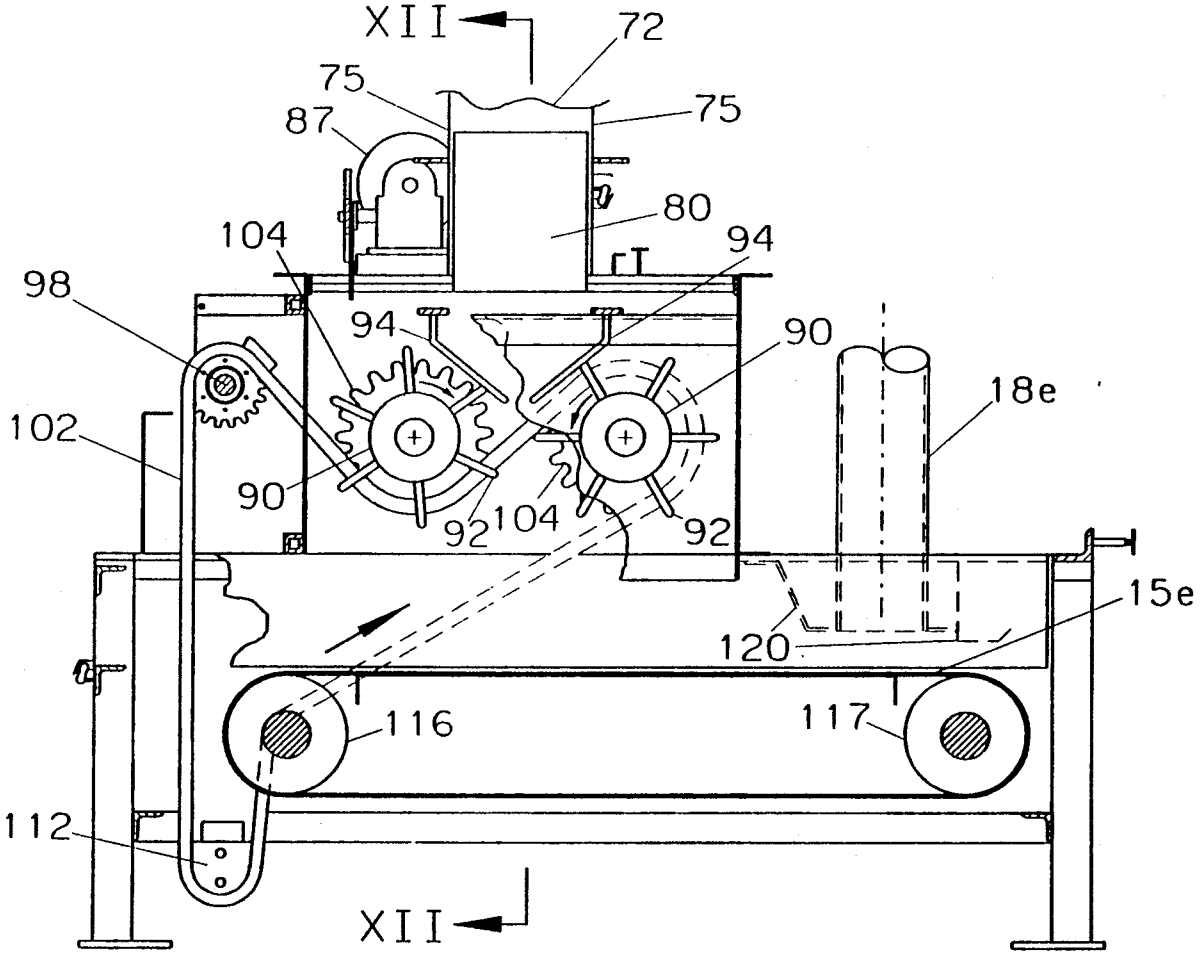
Figure 13:
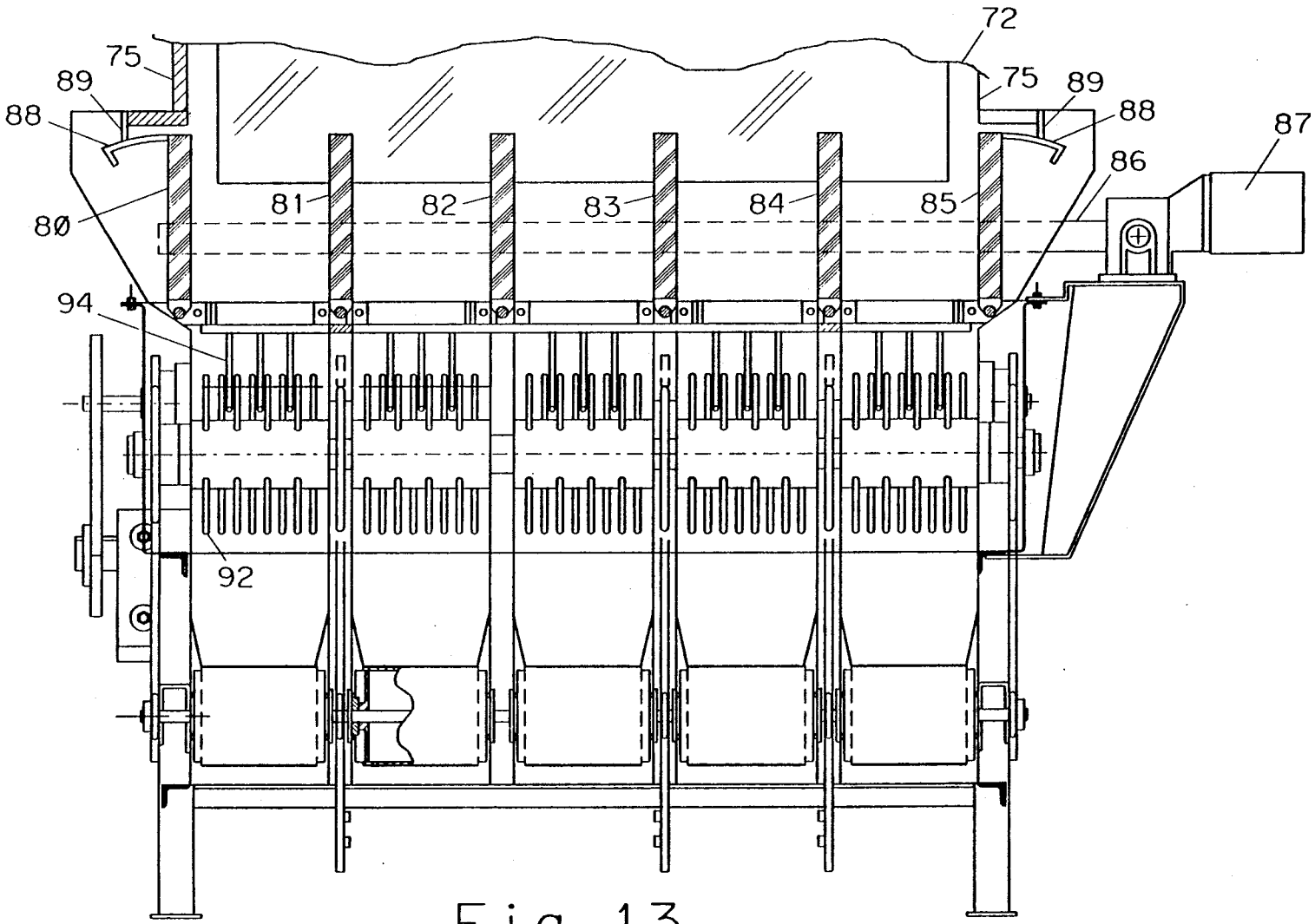

FIGS. 5 A–D show semi-diagrammatic views, in reduced scale, of the following parts of the air valve and pipes shown in FIG. 7, as seen from the left of FIG. 7 (for flow through as in FIG. 2): the left (FIG. 5A) and right (FIG. 5D) fixed outer vertical plates and pipes (in section) through them, and the left (FIG. 5B) and right (FIG. 5C) rotatable vertical end closures (omitting the pipes between them);

FIGS. 6 A–D correspond to FIGS: 5A–D except that the rotatable members are shown in their bypass position (corresponding to FIG. 3);

FIG. 7 shows a vertical section through the axis of rotation of the air flow valve shown in FIG. 2, in enlarged scale;

FIG. 8 shows an exploded isometric perspective view, in reduced scale, of the air flow valve shown in FIG. 7;

FIG. 9 shows the rotatable part of the valve shown in FIG. 8, after rotation to flow bypass position;

FIG. 10 shows an enlarged and partially broken away view of the tobacco bulk supplier and feeder shown in FIG. 2;

FIG. 11 shows a view from the right of FIG. 10 of the feeder shown in FIG. 10;

FIG. 12 shows a further enlarged and broken away view of the feeder shown in FIG. 10;

FIG. 13 shows a section on the line XII—XII in FIG. 12; and

Figure 1:
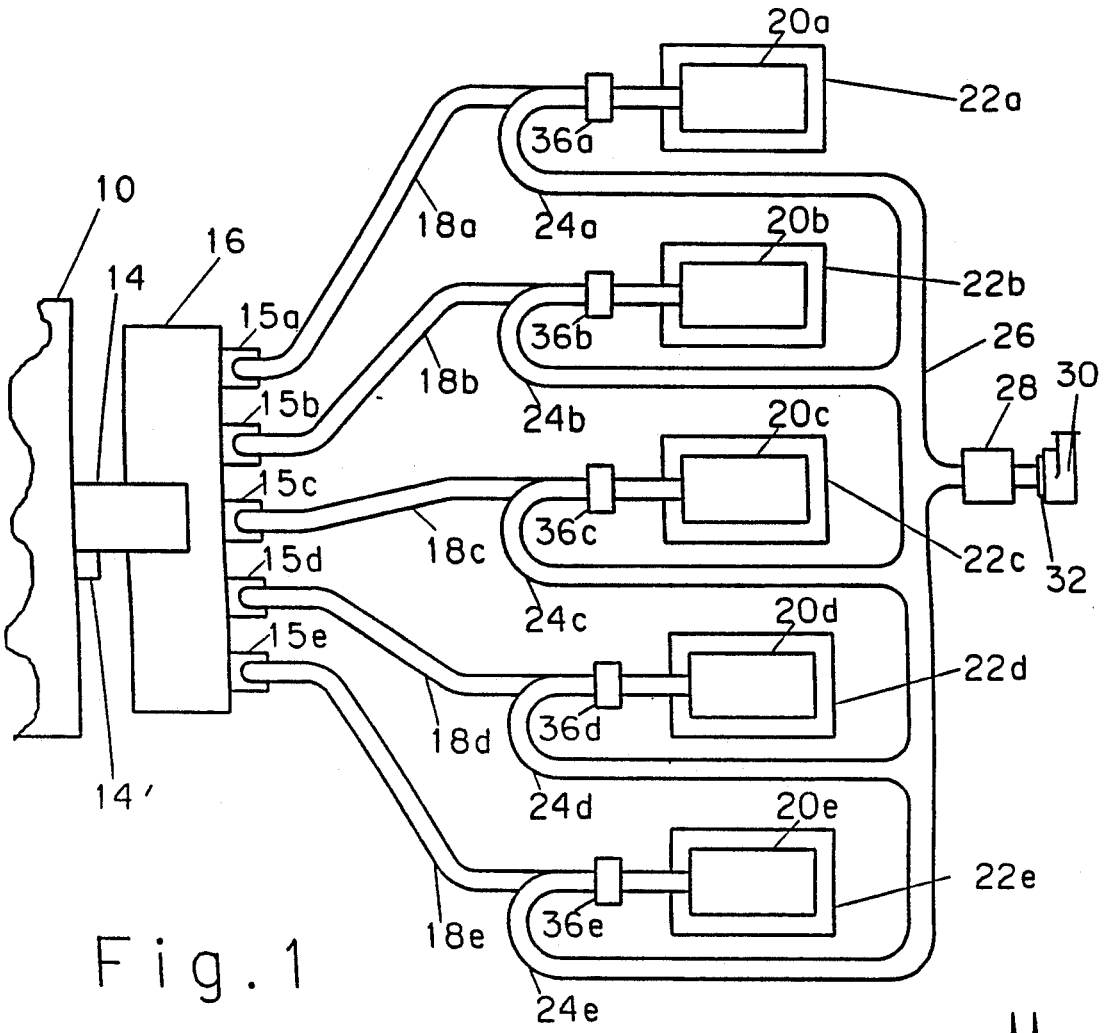
FIG. 1 shows a partially broken away semi-diagrammatic top plan view of a bulk tobacco supply unit and a tobacco feeder connected to an air exhaust fan through pipes and valves to and from the dischargers of several cigarette making machines.
Figure 14:
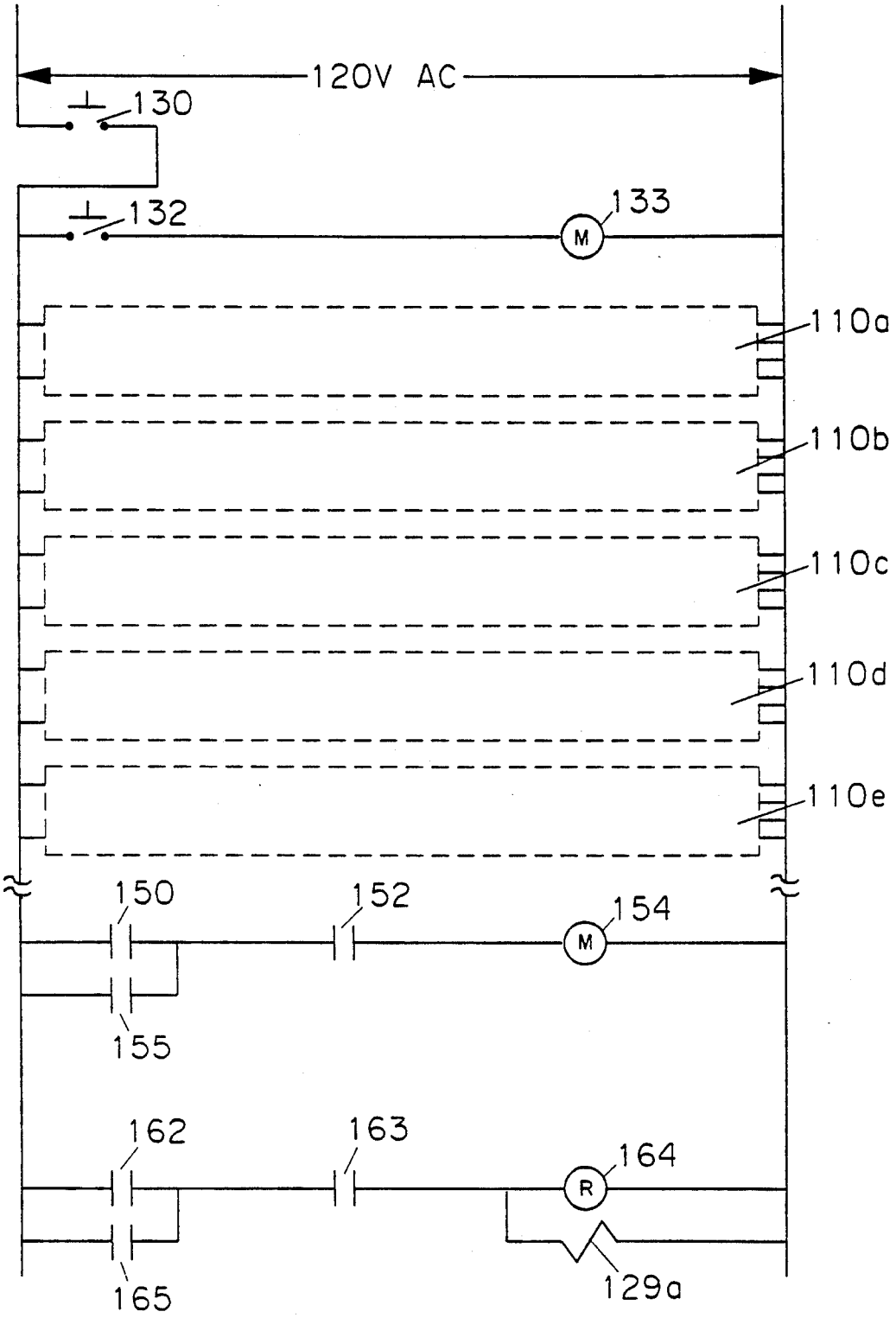
Figure 15:
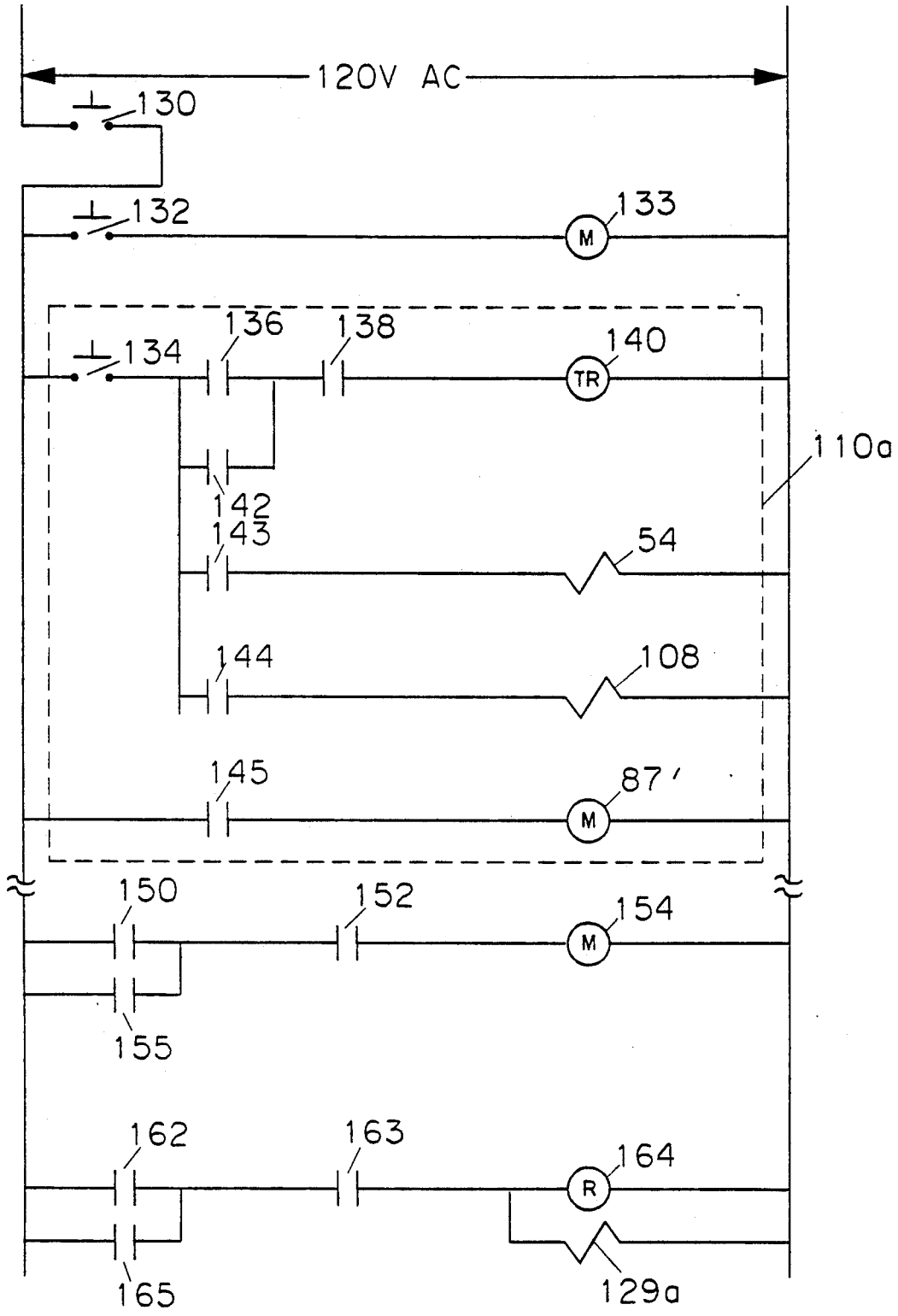
Figure 16:
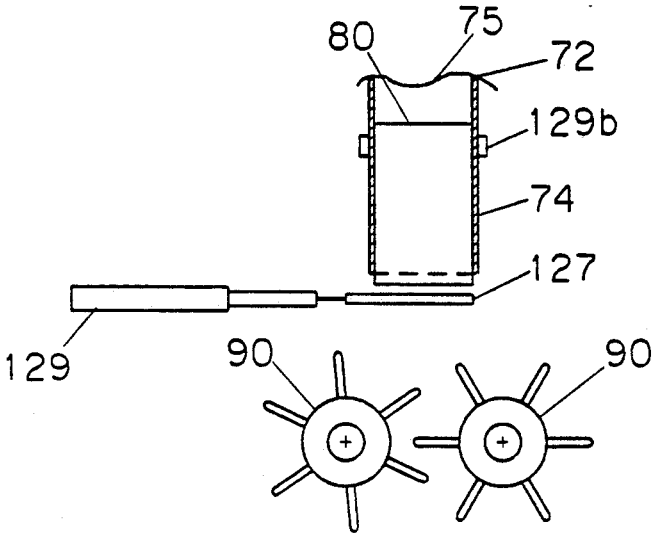
Figure 17:
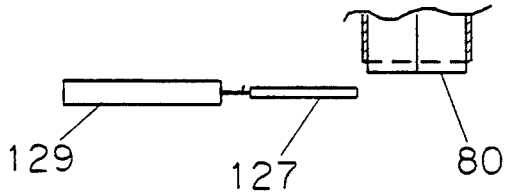

FIG. 14 shows a ladder diagram of the electrical control system for the apparatus of FIGS. 1–3, including several subcircuits;

FIG. 15 shows the ladder diagram of FIG. 14, showing details of one subcircuit and omitting the others;

FIG. 16 shows a broken away view of the upper part of FIG. 12, omitting all but one end of a set of tobaccoseparating vanes and pin wheels beneath them, and adding a retractible gate between the vanes and pin wheels;

FIG. 17 corresponds to FIG. 16 but shows the gate retracted; and

Figure 18:
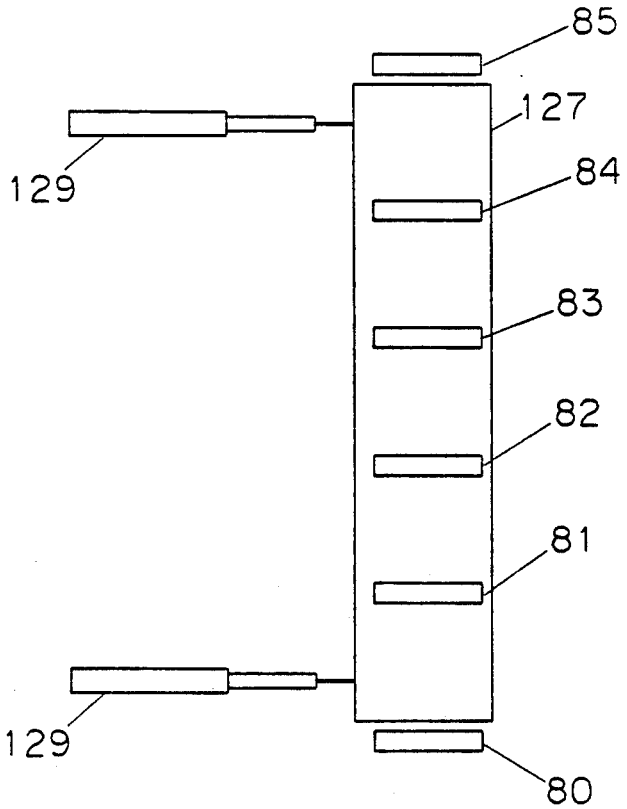

FIG. 18 is a top elevation of what is shown in FIG. 16.

DETAILED DESCRIPTION OF THE ILLUSTRATED EMBODIMENT

Referring now to the accompanying drawings and initially to FIGS. 1 and 2, there is shown a bulk container 10 for holding a supply of tobacco 12 in the form used in cigarettes, and a conveyor belt 14 driven by a motor 14' for transferring tobacco from the container to a feeder unit 16. The feeder 16 divides the tobacco and distributes it on a series of feeder belts 15*a–e* to a corresponding series of pneumatic conveyor pipes 18*a–e*. These pipes respectively deliver the tobacco to a series of discharger devices 20*a–e*, which deliver the tobacco to a corresponding series of cigarette making machines 22*a–e*. The dischargers 20*a–e* retain the tobacco received through pipes 18*a–e* and release the incoming air to a corresponding series of pneumatic exhaust pipes 24*a–e*. These exhaust pipes are all connected through a common manifold 26, to a dust collector 28 and centrifugal exhaust fan 30. The fan is driven at a constant preset speed by a motor 32 to draw air through pipes 18*a–e* and thereby propel tobacco from feeder 16 to dischargers 20*a–e* of the machines 22*a–e*. A damper 34 in each of the exhaust pipes 24*a–e* is adjustable for purposes of evenly balancing the flow of air through pipes 18*a–e*, in accordance with conventional practice.

Each of the dischargers 20*a–e* has a conventional screen 17 over a conventional hopper 19 which receives tobacco from the feeder. The screen retains the tobacco but allows the incoming air to pass on to fan 30. The flow of air through the hopper 19 of any of the dischargers is stopped and started as hereinafter described by an air valve controlling that discharger (see FIGS. 7–9 and air valves 36*a–e* in FIG. 1). Stopping the flow of air through hopper 19 releases the fan-induced vacuum in hopper 19 and thereby permits a conventional door 21 at the bottom of hopper 19 to swing open and allow the tobacco retained in the hopper 19 to pass down into a hopper 27 in the cigarette maker. After hopper 19 empties, and air flow through it and a vacuum in it resumes, the door 21 is drawn shut until the discharge cycle of hopper 19 repeats. A photocell sensor 25 on discharger hopper 19 monitors a predetermined upper level of tobacco in the hopper 19, and a photocell sensor 29 on the hopper 27 monitors a predetermined lower level of tobacco in the maker hopper 27. As in conventional practice when such sensors control a valve on the air exhaust side of the discharger, the door 21 may be opened and closed simply by changes in air pressure when air flow stops and starts, or may be held closed by mechanical means which release only after sensor 29 signals for release of tobacco to the hopper 27 from hopper 19. In either case photocell sensors 25 and 29 are in series so that both have to signal for a shift from stopping to starting air flow through discharger hopper 19, as hereinafter described in connection with the control system shown in FIGS. 14 and 15. Such a photocell or photoelectric sensor comprises means to emit a directed beam, to sense or "see" whether the beam is interrupted by the presense of an object (such as tobacco) in the beam, and a relay to signal or operate a control in response to sensing or not sensing such object.

A series of identical valves 36*a–e* are operable to provide a substantially constant flow of air through the pipes 18*a–e* to manifold 26 and exhaust fan 30, whether or not air flow through some or all of the dischargers 20*a–e* is stopped from time to time. This maintains the original adjusted balance and rate of flow through pipes 18*a–e* and 24*a–e* to exhaust fan 30, and is accomplished by means for bypassing the airflow around any discharger where the flow through it is cut off.

In the case of valve 36*a* and pipes 18*a* and 24*a*, for example, portions of these pipes near discharger 20*a* extend side by side, with the flow moving through them in opposite directions, and valve 36*a* extends across these portions so it can be moved between a first setting which permits uninterrupted flow through each of the pipes 18*a* and 24*a* to, through and from tobacco discharger 20*a* (FIG. 2) when discharger 20*a* is receiving tobacco, and a second setting which reconnects pipe 18*a* directly to pipe 24*a* in a manner which bypasses air flow around tobacco discharger 20*a* (FIG. 3) when tobacco in hopper 19 is to be discharged into hopper 27 of cigarette making machine 22*a*.

All of the valves 36*a–e* are in the first (flow-through) setting when all of the dischargers 20*a–e* are receiving tobacco. When one of the discharger hoppers 19 is to discharge tobacco to the adjacent hopper 27, the corresponding air flow valve for that discharger is left in its first setting until all of the tobacco in the corresponding supply pipe has been drawn into the discharger, where the tobacco is retained. The said corresponding valve is then shifted to its second setting, which bypasses the discharger to maintain the original amount of air flow to exhaust fan 30 while at the same time shutting off air into and from the discharger and thereby enabling the discharger hopper 19 to release tobacco to the adjacent hopper 27. In its second setting, each value bypasses all discharge hoppers to form a direct connection to the corresponding one of pipes 24*a–e*.

Each of the air valves 36*a–e* has an outer case 38 (FIGS. 4–8) mounted in a fixed position, and a hollow air-tight cylinder 40 rotatable about its cylindrical axis within the case 38. Cylinder 40 is supported on a shaft 42 extending along its central axis and through its circular end closures 44 and 46, to which the shaft is secured. The ends of shaft 42 projecting from cylinder 40 are journaled in rectangular plates 48 and 50 at opposite ends of case 38. Art actuator 52 is secured to the outside of plate 48 and connected through a coupling 54 to turn shaft 42 and cylinder 40 a quarter turn (90°) in one direction, and back a quarter turn to the original position. Actuator 52 is a conventional unit comprising a double-acting piston in a cylinder, a spool valve controlling flow of compressed air to opposite sides of the piston, a spring-biased solenoid 56 to operate the piston, a rack movable lengthwise by the piston, and a pinion rotable by the rack. The pinion is connected to cylinder 40 to turn it a quarter turn in one direction when solenoid 56 is energized and a quarter turn in the opposite direction when solenoid 56 is de-energized, as hereinafter described in connection with FIGS. 14 and 15.

Valve cylinder 40 has a pair of parallel pipe sections 18*x* and 24*x* secured between its end closures 44 and 46 (FIG. 8). The internal diameters of pipe sections 18*x* (for example, five inches) and 24*x* (for example, six inches) correspond to those of the respective pipes 18*a–e* and 24*a–e*. Pipe 18*a* has a first part extending from feeder 16 to valve 36*a* and a second part extending from valve 36*a* to discharger 20*a*, and pipe 24*a* has a first part extending from discharger 20*a* to valve 36*a* and a second part extending from valve 3*ba* to manifold 26. The ends of said first part of pipe 18*a* and second part of pipe 24*a* extend through plate 48 and project there from close to the end closure 44 of cylinder 40, where they are closely encircled by a pair of sealing rings 62, which are pressed by springs 63 into sliding and air sealing engagement with end closure 44. An end of said second part of pipe 18*a* and an end of said first part of pipe 24*a* similarly project through plate 50 to carry like sealing rings 62 which are spring pressed against end closure 46.

Figure 5A:
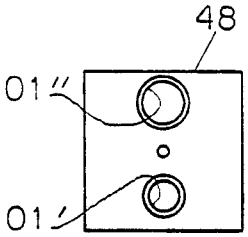
Figure 5B:
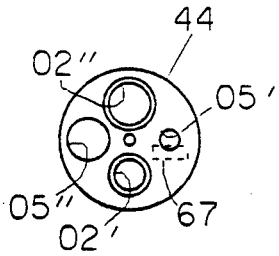
Figure 5C:
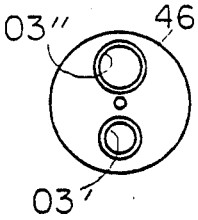
Figure 5D:
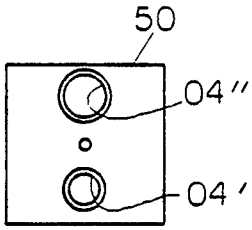
Figure 6A:
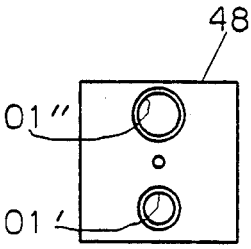
Figure 6B:
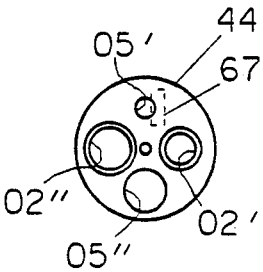
Figure 6C:
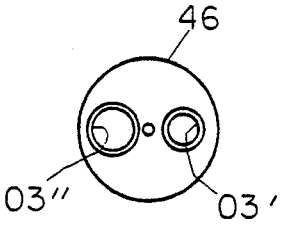
Figure 6D:
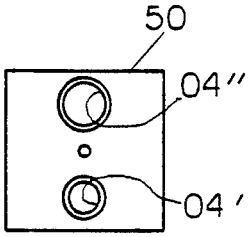

Valve cylinder 40 is rotatable to bring its pipe sections 18*x* and 24*x* into alignment with said ends of pipes 18*a* and 24*a* extending through plates 48 and 50 of case 38. A pair of openings 01' and 01" through plate 48, a pair of openings 02' and 02" through closure 44, a pair of openings 03' and 03" through closure 46 and a pair of openings 04' and 04" through plate 50 (FIGS. 5A–D) provide clear passages through both parts of pipe 18*a* and pipe section 18*x* and through pipe 24*a* and pipe section 24*x* when cylinder 40 is rotated to bring these pipes and corresponding pipe sections into alignment, which is the flow-through position of cylinder 40 (FIGS. 5B and D). When cylinder 40 is rotated a quarter turn to its second position (counterclockwise from FIGS. 5B and C to FIGS. 6B and C), which is its bypass position, a second set of openings 05' and 05" through end closure 44 are brought into alignment with the ends of pipes 18*a* and 24*a* extending through plate 48. The diameters of these openings are the same as the internal diameters of the pipes 18*a* and 24*a* with which they are aligned, except that the opening 05' through cylinder end closure 44 has a diameter (about 3 inches) smaller than the internal diameter of the exhaust pipe 24*a* (about 6 inches) with which it is aligned during bypass, to maintain like air flow. There are no openings corresponding to openings 05' and 05" through the other end closure 46. Consequently, in the said second setting of cylinder 40, openings 03' and 03" are blocked by plate 50 and air entering the cylinder from pipe 18*a* through opening 01' and 05' can only escape from the interior of cylinder 40 through openings 02" and 01" into the adjacent end of pipe 24*a*, which extends to manifold 26 and thence to exhaust fan 30. In order to adjust for equalizing any slight change of flow through pipes 18*a* and 24*a* between the two settings of cylinder 40, a plate 67 is adjustably mounted on the inner face of closure 44 to extend partially across opening 66.

The flow of tobacco through feeder 16 begins at a funnel 70 (FIGS. 10 and 11) positioned to receive deliveries of tobacco from conveyor belt 14. Funnel 70 discharges the tobacco into the top of a metering tube 72. Both are of rectangular horizontal cross section. Tube 72 has two opposite side walls 74 which diverge progressively from top to bottom for purposes of reducing any tendency of tobacco to become wedged between the walls 74 enough to form bridging which prevents the tobacco from falling further down. The other pair of opposite walls 75 of tube 72 extend straight down and are spaced further apart from each other than the walls 74 are spaced.

The lower end of metering tube 72 has flow dividing vanes 80, 81, 82, 83, 84 and 85 (FIGS. 10–13) extending transversely between the lower ends of walls 74. The lower edges of the vanes are hinged about axes extending transversely between the lower edges of walls 74. As the vanes swing back and forth about 10 degrees, for example, on each side of the vertical positions of the vanes, their side edges almost touch the walls 74. One side of each vane is connected to a horizontal bar 86 which is reciprocated by a motor 87 to swing the vanes at a rate of about 100 cycles per minute, for example, while feeder 16 is feeding tobacco. When all the vanes are in their vertical position, their top surfaces lie substantially in a flat horizontal plane, in order to let the tops of the vanes slide under tobacco above them. Sharp edges at the tops of the vanes are not desirable because of the tendency of the tobacco to drape over the edges and form bridges. The top of each of the end vanes 80 and 85 is beneath the bottom edge of one of the end wall 75, and has an outward extension 88 curving in an arc about the vane's hinge axis and having an upper surface slidable against a wiper 89 attached to the bottom of one of the end walls 75. The end vanes 80 and 85 are thus able to swing in concert with the intermediate vanes 81–84 without permitting tobacco to spill over the top of whichever end vane is swinging outwardly beyond the adjacent end panel of tube 72. The inner surfaces of end vanes 80 and 85, are flush with the inner surfaces of end panels 75, and vanes 80–85 are spaced equally apart from each other, so that five vertical passages of equal cross-sectional area are formed between the successive vanes and walls 78.

Each of the said five spaces between the vanes overlies one of a series of five pairs of parallel pin rolls 90 which control down flow of tobacco from the respective spaces between the vanes. Pins 92 project radially to an equal extent from each of the rolls 90. The pins of each roll are spaced apart from each other and each roll has about six rows of pins spaced from each other along each row, which extends parallel to the roll axis. The rows of pins on each roll are spaced equally from each other circumferentially of the roll. A pair of identical rolls 90 are mounted side by side beneath each of the spaces between the vanes 80–85. The rolls of each pair turn at the same rate and their axes are parallel and spaced apart slightly more than twice the radial distance from the axis of a roll to the tip of a pin on the roll. The rows of pins of the two rolls are rotationally offset so that when a row of pins of one of the rolls is in the plane through the roll axes, the nearest rows of pins of the other roll are equally far from opposite sides of that plane (FIG. 12). A pair of rows of fixed pins 94 extend downwardly from where their upper ends are fixed to supports extending along opposite sides of the lower ends of the row of vanes 80–85. Each pair of rows of fixed pins 94 are inturned to slant toward each other and at their lower ends come close to but not touch each other or the pins 92. When a pair of rolls 90 are not rotating, their pins 92 and the adjacent fixed pins 94 are effective to prevent tobacco from moving past that pair of rolls. When a pair of rolls 90 rotate, they discharge tobacco beneath them and thereby cause the tobacco above them to move down through the space between the vanes above them.

Pin rolls 90 (FIG. 12) are freely rotatable about a pair of horizontal fixed shafts 96 extending along opposite sides of the row of vanes 80–85. All of the rolls 90 have a driving connection with a common jackshaft 98 extending horizontally along one side of the row of vanes 80–85 and driven by a motor 100. Each pair of pin rolls 90 is driven independently of the other pin rolls by its own connections to the Jackshaft through one of a series of chains 102. Each chain 102 is trained around a pair of sprockets 104 keyed to the pair of pin rolls, and around a sprocket 106 rotatable by the Jackshaft under control of one of a series of five magnetic clutches 108. When a magnetic clutch 108 is activated it engages the Jackshaft to drive the associated sprocket 106 and hence associated chain 102, sprockets 104 and pair of pin rolls. When clutch 108 is deactivated the associated sprocket 106 idles on the Jackshaft and the associated chain 102 becomes inactive and no longer drives the associated pair of pin rolls and feeder belt. An electrical control circuit 109 (FIG. 14) has component subcircuits 110*a–e* each having switches to control one of the five magnetic clutches 108 for driving one of the five pairs of pin rolls 90 and the associated one of the feeder belts 15*a–e*.

Each of the chains 102 is also trained around a chain tightening device 112 and around a sprocket 114 fixed to a roller 116 for driving one of the feeder belts 15*a–e*. Roller 116 and a roller 117 support the feeder belt. Tobacco coming from each of the spaces between the vanes 80–85 is delivered on one of the feeder belts 15*a–e* to an adjacent one of the pipes 18*a–e*. The upper reach of each feeder belt extends horizontally beneath one of the pairs of pin rolls 90 and also beneath the intake end of one of the pipes 18*a–e*, in order to convey the tobacco released by one of the pairs of pin rolls 90 where it can be drawn up into one of the pipes 18*a–e*. When one of the clutches 108 connects or disconnects the chain drive to one of the pairs of pin rolls, it simultaneously connects or disconnects the chain drive to the feeder belt beneath that pair of pin rolls. The intake end of each of the pipes 18*a–e* has a hood 120 around it spaced above the adjacent feeder belt, so that tobacco on the feeder belt is drawn between the belt and hood toward the intake, where the tobacco is drawn into the pipe.

The side walls 74 of the metering tube 72 have large areas of clear plastic which permit viewing tobacco between the walls from outside of the feeder 16. A reflector 122 is mounted near the top of a plastic area near the top of one of the walls 74 and a retroreflective photocell 124 focused on the reflector 122 is mounted on the outside of an opposite plastic area of the other wall 74. A similar reflector 126 and retro reflective photo cell 128 are mounted on the outside of lower plastic areas of the side walls 74, above and between the vanes 82 and 83. The photocells 124 and 128 operate a set of contacts 130 controlling the motor 14' which drives the conveyor belt 14 supplying tobacco to feeder 16. The photocell 124 also controls movement of the gate 127 described in the next paragraph.

Tobacco in feeder 16 may be cleaned out from time to time, such as when shifting cigarette makers 22*a–e* from making one brand of cigarette to making another. In that case, the tobacco which is ordinarily .held between each pair of pin wheels 90 is no longer there, and the new tobacco initially coming down between the vanes 80–85 tends to drop past the pin wheels instead of being held back by them. In order to prevent that from happening, a horizontal gate 127 (FIGS. 16–18) is mounted on feeder 16 for horizontal movement to and from a position between the lowermost ends of vanes 80–85 and the uppermost reach of the pin wheels 90. While in said position, gate 127 extends across the lower ends of each pair of adjacent vanes 80–85 and holds back any tobacco which would otherwise fall onto the pinwheels 90 beneath. A pair of air cylinders 129 controlled by a solenoid coil 129*a* move gate 127 to its said position, and retract it to a position where it is out of the way of tobacco passing between vanes 80–85. Solenoid coil 129*a* is controlled by photocell sensor 124 and also by an additional photocell sensor 129*b* which is mounted near the bottom of metering tube 72, between the lower ends of vanes 82 and 83, to detect when all tobacco is out of the metering tube.

The ladder diagram of FIG. 14 shows the controls for operating the apparatus shown in FIGS. 1–13. A modified form of the FIG. 14 diagram is shown in FIG. 15, where subcircuit 110*a* is shown in detail and subcircuits 110*b–e* are omitted. The following paragraphs (1)–(5) identify the circuit elements shown in these Figures, and paragraph (6) summarizes their operations:

(1) On/off switch contacts 130 control power (120 V AC) to the control circuit for the entire apparatus shown in FIG. 1.

(2) On/off switch contacts 132 control power to the starter coil 133 for energizing Jack shaft motor 100.

(3) The control subcircuits 110*a–e* (shown in FIG. 14 within dotted line boxes) are duplicated for each machine 122*a–e* and its discharger, airflow valve and parts of the feeder 16 supplying tobacco to that particular discharger. The subcircuit 110*a*, for example, has the following components (shown in FIG. 15):

(i) On/off switch contacts 134 control power to circuit 110*a*.

(ii) Contacts 136 are closed by a signal from photocell sensor 29 that tobacco in the hopper 27 of the cigarette making machine 22*a* is below the level monitored by its photocell 29, indicating that hopper 27 is sufficiently empty to receive a resupply of tobacco.

(iii) Contacts 138 are closed by a signal from the photocell sensor 25 when it does not sense tobacco in the hopper 19 of discharger 20*a*.

(iv) Contacts 142–145 are controlled by timer relay 140.

(v) Solenoid coil 54 controls shifting of air valve 36*a*.

(vi) Magnet clutch 108 controls engagement of jack shaft 98 to cause feeding of tobacco to supply belt 15*a*.

(vii) Motor starter 87' controls the operation of vane drive motor 87.

(4) Within the main control circuit, but outside any of the subcircuit 110*a–e*, are contacts 150, 152, and 155, and a motor starter coil 154 for the motor 14' which operates the conveyor belt 14 to supply tobacco from bulk container 10 to metering tube 72 of feeder 16. Contacts 155 are closed while starter coil 154 is energized.

(5) Also within the main control circuit, but outside any of the subcircuits 110*a–e*, are contacts 162, 163 and 165, a relay 164, and the solenoid coil 129*a* which operates valves controlling the air cylinders 129 for advancing and retracting gate 127. Contacts 162 are controlled by photocell sensor 129*b*. Contacts 163 are controlled by photocell sensor 124. Contacts 165 are controlled by relay 164.

(6) An example of the operation of the above mentioned controls is as follows, starting with no tobacco in the system beyond bulk container 10:

(a) Contacts 130 are closed to power the control system as a whole. Exhaust fan 30 is conventionally not included in the control circuit and hence is turned on independently.

(b) When contacts 130 are closed, photocell sensors 124 and 128 detect the absence of tobacco in metering tube 172 and cause their respective contacts 152 and 150 to close. The closed contacts 152 and 150 are in series and energize motor starter 154, which causes tobacco to be fed from the bulk container 10 to metering tube 72. Contacts 155 are closed while motor starter 154 is energized and are in parallel with contacts 150, thereby preventing the de-energization of motor starter 154 when the lower photocell 128 sees tobacco as the metering tube 72 is being filled. When metering tube 72 is filled above the level of photocell 124, it sees tobacco and opens contacts 152. This de-energizes motor starter 154 and stops the feeding of tobacco on belt 15*a*. This sequence of operations repeats when feeder 16 withdraws enough tobacco from metering tube 72 on belts 15*a–e* to cause the lower photocell 128, as well as the upper photocell 124, to see no tobacco in metering tube 72.

(c) Also upon closing of contacts 130, photocells 160 and 124 see no tobacco and cause contacts 162 and 163 to close. These are in series with each other and energize relay 164 and solenoid 129*a*. Contacts 165 close to prevent the de-energizing of relay 164 and solenoid 129*a* when photocell 162 sees tobacco as metering tube 72 fills. Energizing solenoid 129*a* causes the air cylinders 129 to extend gate 127 to prevent tobacco from falling past the vanes 80–85. When the metering tube fills above the level of photocell 124, it sees tobacco and opens contacts 163. This de-energizes relay 164 and solenoid 129*a* and causes gate 127 to retract so that tobacco can be fed past pin wheels 90 onto belts 15*a–e*.

(d) When subcircuit 110*a*, for example, is activated by closing contacts 134, and the hoppers 27 and 19 of the cigarette maker 22*a* and its discharger 20*a* controlled by the circuit are empty, the sequential operation of the subcircuit is as follows:

(i) Photocells 25 and 29 on hoppers 19 and 27 detect the absence of tobacco and cause their respective contacts 136 and 138, which are in series, to close and energize timer relay 140. It immediately closes all of the contacts 142–145

(ii) Contacts 142 are in parallel with contacts 136 and close to prevent de-energization of timer relay 140 as a result of tobacco tumble in the maker hopper 27 interrupting the beam of photocell 29 during subsequent refilling of hopper 27.

(iii) Closing of contacts 143 energizes solenoid 154 and causes the air valve 136*a* to rotate to its flow-through position.

(iv) Closing of contacts 144 energizes magnetic clutch 108 to engage Jack shaft 98 to feed tobacco to belt 15*a* for delivery through supply pipe 18*a* to discharger 20*a*.

(v) Closing of contacts 145 energizes motor starter 87' to cause motor 87 to drive vanes 880–85.

(vi) When discharger hopper 19 is nearly full, photocell 25 sees tobacco and opens contacts 138, thereby de-energizing timer relay 140. It immediately opens contacts 142, 144, and 145, but delays opening of contacts 143 until the end of the preset time period.

(vii) The opening of contacts 142 has no effect except to restore the series control of timer relay 140 by contacts 136 and 138.

(viii) The opening of contacts 144 disengages clutch 108 to stop the feed of tobacco to belt 15*a*.

(ix) The opening of contacts 145 stops the vane drive motor 87' unless one or more of the corresponding contacts 145 in the subcircuits 110*b–e* remain closed, which would be the case while tobacco is being fed on one or more of the belts 15*b–e*.

(x) After a preset time (sufficient to allow tobacco to be purged from the supply tube 18*a*) the opening of contacts 143 by timer relay 140 causes air valve 36*a* to rotate to bypass position.

(xi) Rotation of air valve 36*a* to bypass position causes pressure in the discharger hopper 19 to return to atmospheric. Hopper door 21 then opens and allows tobacco in discharger hopper 19 to empty into the maker hopper 27.

(xii) The above sequence of paragraphs (6)(d)(i)–(xi) is repeated each time the level of tobacco in maker hopper 27 falls below photocell 29.

While present preferred embodiments and methods of practicing the invention have been illustrated and described, it will be understood that the invention is not limited thereto but may be otherwise variously embodied and practiced within the scope of the following claims.

I claim:

1. Apparatus for supplying tobacco, comprising a plurality of machines for making cigarettes, a discharger hopper and an adjacent supplemental hopper for each machine, each discharger hopper having an inlet to receive a flow of air and any entrained tobacco, having means for releasing said air while retaining said tobacco, and having means for subsequently discharging the retained tobacco into the adjacent supplemental tobacco hopper, a corresponding number of supply conduits each connected to one of the discharger hopper inlets, an exhaust fan for drawing air and any entrained tobacco through the supply conduits to the discharger hopper inlets, an exhaust conduit system for conveying to the exhaust fan the air released by the discharger hoppers, and a corresponding number of air values each connected to one of the supply conduits and to the exhaust conduit system by an indirect connection leading to the inlet of the corresponding discharger hopper and by a direct connection which bypasses all the discharger hoppers, each valve having means for shifting the valve between a first setting where a stream of air and any entrained tobacco received by the valve from the corresponding supply conduit passes to the corresponding discharger hopper inlet, and a second setting where a stream of air and any entrained tobacco received by the valve is diverted to the exhaust conduit system without passing through any of the discharger hopper inlets whereby shifting of the valves independently of each other in response to varying amounts of tobacco consumed by the machines does not substantially change the total air being drawn from the supply conduits by the exhaust fan.

2. Apparatus according to claim 1, comprising means for supplying tobacco to said supply conduits for entrainment in the air drawn by said exhaust fan through said supply conduits, said tobacco supply means including means for starting and stopping supply of tobacco to any of said supply conduits independently of the others, whereby the supplying of tobacco to any supply conduit may be stopped before the corresponding air valve is shifted to divert air to the exhaust conduit system, and may be resumed when the corresponding air valve is shifted back again to direct air and any entrained tobacco to the corresponding discharger hopper inlet.

3. Apparatus according to claim 2, comprising a sensor means for monitoring each discharger hopper to detect and indicate whether the level of tobacco therein is below a predetermined level, a sensor means for each of said supplemental hopper for detecting and indicating the level of tobacco therein relative to a predetermined level, control means connected to each of said air valves and to said means for supplying tobacco to each supply conduit, said control means being responsive to each said sensor means for monitoring a discharger hopper to stop the supply of tobacco to the supply conduit connected to the monitored discharger hopper when that sensor means indicates that the level of tobacco in that discharger hopper is above its said predetermined level, and also being responsive to said indication to cause the air valve connected to said supply conduit to shift to said second setting.

4. Apparatus according to claim 1, comprising means for delaying for a predetermined period the said shifting of any of said air valves to its second setting, said predetermined period being the length of time needed to clear entrained tobacco from the supply conduit connected to the valve after stopping supply of tobacco to that supply conduit.

5. Apparatus according to claim 1, comprising a sensor means for monitoring each discharger hopper to detect and indicate the level of tobacco therein relative to a predetermined level, a sensor means for monitoring each of said supplemental hoppers to detect and indicate the level of tobacco therein relative to a predetermined level, and control means connected to said air valves, to each said sensor means, and to said means for supplying and stopping supply of tobacco to each supply conduit, said control means being responsive to indication by the sensor means for monitoring any of said discharger hoppers and by the sensor means for monitoring the adjacent supplemental hopper that the respective levels of tobacco in that discharger hopper and in the adjacent supplemental hopper are both below their respective predetermined levels, and effective upon said indication by both sensor means to cause said tobacco supply means to supply tobacco to the supply conduit connected to that discharger hopper, and to shift the air valve connected to that supply conduit to said first setting.

6. Apparatus according to claim 1, in which said valve shifting means comprises a rotatable portion of the valve, and a pair of passages which are parallel to its axis of rotation, one of said passages being interposed in and serving as part of the supply conduit connected to the valve when the valve is in said first setting, and the other of said passages being interposed in and serving as part of the exhaust conduit system when the valve is in said first setting.

7. Apparatus according to claim 6, in which said air passages are connected to the supply conduit connected to the valve and are connected to the exhaust conduit system so that air flow through said passages is in opposite directions when the valve is in said first setting, and in which said rotatable portion comprises a chamber which when the valve is in said second setting is connected to receive air from the supply conduit connected to the valve and is connected to discharge air directly into the exhaust conduit system.

* * * * *